United States Patent [19]

Mayo et al.

[11] 4,393,745

[45] Jul. 19, 1983

[54] RELEASABLE RETAINER FOR EJECTION TUBE

[75] Inventors: Henry C. Mayo; William V. Millman, both of Alexandria, Va.

[73] Assignee: The United States of America as represented by the Secretary of the Army, Washington, D.C.

[21] Appl. No.: 288,624

[22] Filed: Jul. 30, 1981

[51] Int. Cl.[3] ..... F41F 3/04

[52] U.S. Cl. ..... 89/1.806; 89/1.816

[58] Field of Search ..... 89/1.806, 1.812, 1.807, 89/1.816, 1.819, 1.8

[56] References Cited

U.S. PATENT DOCUMENTS

| | | | |
|---|---|---|---|
| 2,826,960 | 3/1958 | Schiavi | 89/1.806 |
| 2,848,925 | 8/1958 | Hood | 89/1.806 |
| 3,412,640 | 11/1968 | Nash | 89/1.806 |
| 3,504,593 | 4/1970 | Ricks et al. | 89/1.816 X |
| 4,132,150 | 1/1979 | Conn | 89/1.806 |
| 4,191,087 | 3/1980 | Campbell et al. | 89/1.806 |

FOREIGN PATENT DOCUMENTS

| | | | |
|---|---|---|---|
| 154961 | 6/1956 | Sweden | 89/1.806 |
| 777920 | 6/1957 | United Kingdom | 89/1.806 |

*Primary Examiner*—David H. Brown

*Attorney, Agent, or Firm*—Robert P. Gibson; Anthony T. Lane

[57] ABSTRACT

A restraining device having a tooth which is biased by a spring through a slotted support. The device is attached to the exhaust end of a rocket launch tube to permit easy loading of the rocket into the tube prior to firing, and to restrain the rocket in the tube. The configuration of the device provides positive retention of the rocket in the tube, even when subjected to overpressure of rockets being fired in adjacent launch tubes.

9 Claims, 8 Drawing Figures

FIG. 1
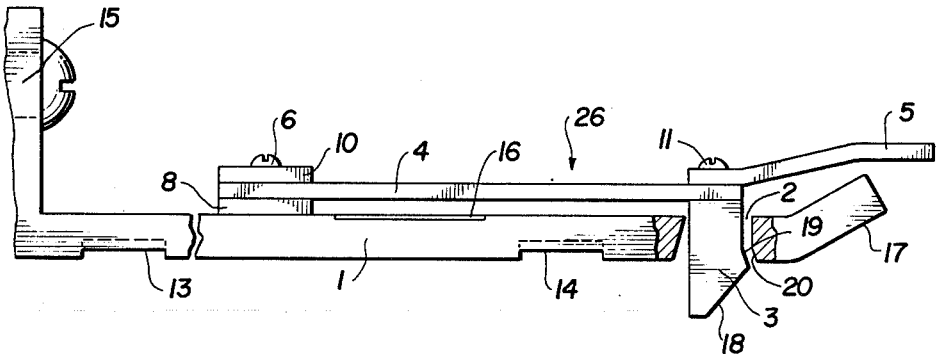
FIG. 2
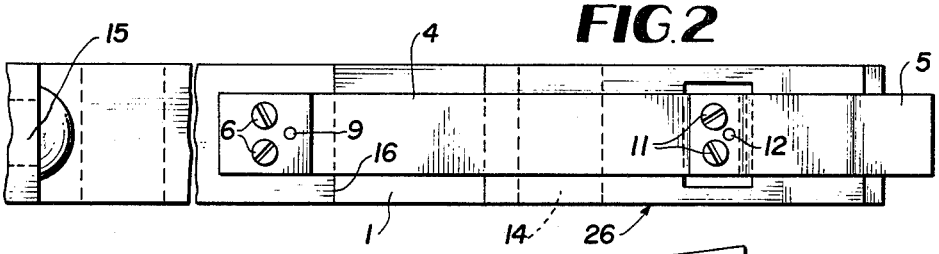
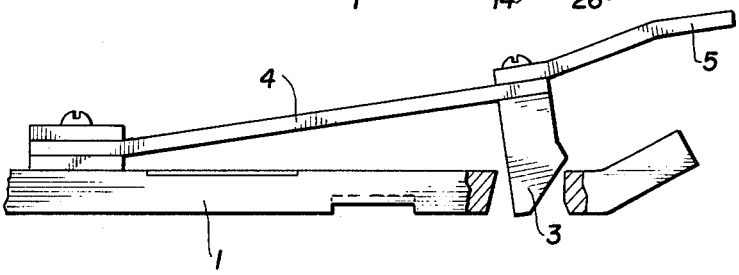
FIG. 3
FIG. 4
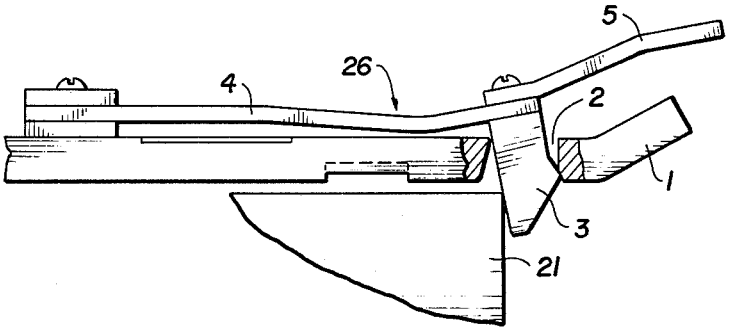
FIG. 5
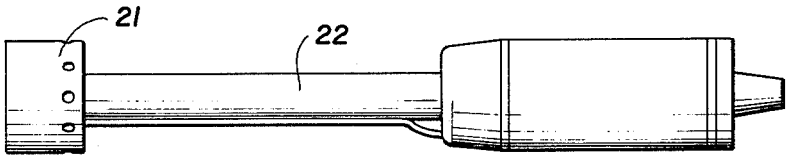

FIG. 6
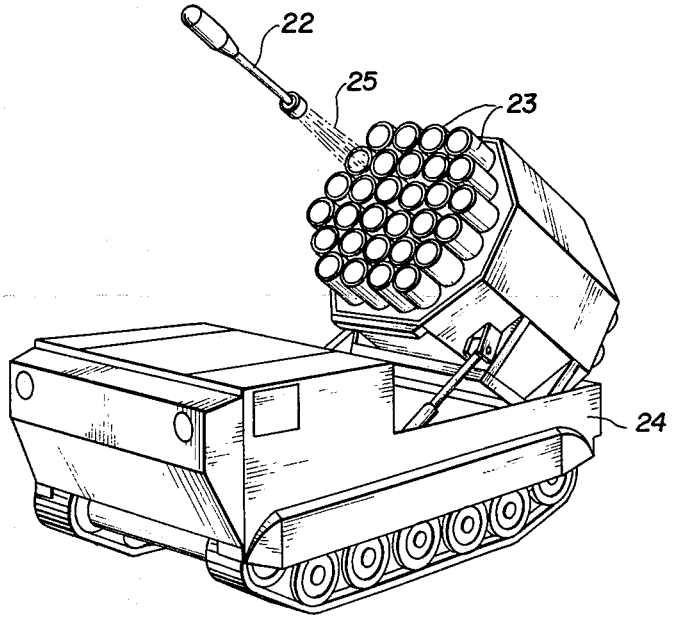
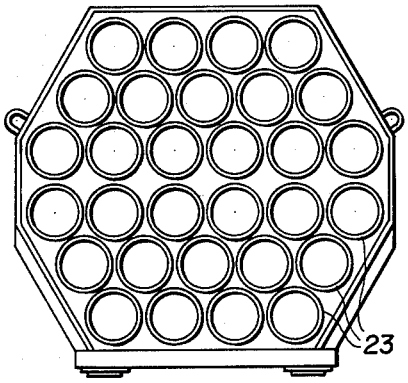
FIG. 7
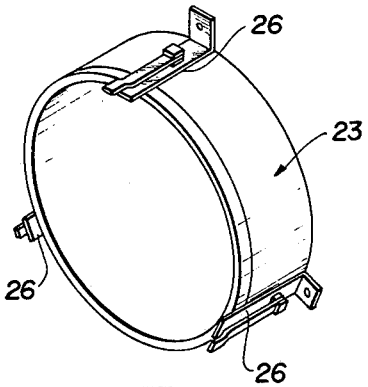
FIG. 7a

RELEASABLE RETAINER FOR EJECTION TUBE

BACKGROUND OF THE INVENTION

The invention relates to automatic restraining of rockets in position in launch tubes before firing and during firing of rockets in adjacent launch tubes. The invention may be used in structures which require easily operated and positive retention means. Particularly the device relates to rocket detents having spring actuation and slotted supports.

Heretofore, rocket detents have made use of spring type detents, including a restraining tooth. Such detents are at a disadvantage for restraining the rocket in the tube during backblast of adjacent rockets, and during manual removal of the rockets from the launch tube. With present designs, the spring must be very strong to overcome the backblast problem resulting in an excessive manual force of 40 lbs. or more to release the detent. This excessive spring stiffness required to restrain the rockets also makes manual downloading very difficult. However, if the spring is made not excessively strong for easy downloading, then experience has shown that backblast from firing a rocket in an adjacent tube will cause the detent to release a rocket from a non-firing tube onto the ground, particularly in cold weather. Present designs are also at a disadvantage with respect to equalization of restraining forces when multiple devices are used to restrain the same rocket. In addition, another known detent design incorporating rotational motion of the tooth or latch as in U.S. Pat. Nos. 3,504,593 to Ricks et al.; 4,191,087 to Campbell et al. has the disadvantage of allowing excessive movement of the rocket in the launch tube. This free movement could be as much as one-quarter inch, possibly resulting in damage to the rocket during transport. A detent incorporating a flat spring, beveled tooth and slotted support as in the present invention provides secure storage of rockets in launch tubes under all conditions, including transport and exposure to backblast of adjacent rockets. Due to the above-noted inadequacies of the prior art, this need has gone unfulfilled until the present invention.

OBJECTS AND SUMMARY OF THE INVENTION

It is an object of this invention to provide a detent construction which incorporates a latching tooth permitting easy passage of an item in one direction, but locks securely to prevent passage in the opposite direction.

Another object of this invention is to provide a detent construction in which a detent having a slot is fitted with a spring-operated latching tooth which passes through the slot in the support and locks by means of contact with the support when the tooth is loaded in one direction.

Still another object of the invention is to provide a detent suitable for restraining items securely in place after insertion into a storage chamber, such as restraining rockets in launch tubes after the rocket is loaded into the tube in preparation for travel or firing.

A further object of the invention is to provide a detent which is easily engaged, easily released manually, and securely restrains/holds a rocket in place even during adverse loads of backblasts of rockets firing in adjacent tubes.

Another object is to provide a device which may be used to restrain any item carried in a hollow support from moving in one direction.

This invention is directed toward a restraining detent construction wherein a slotted rocket support is fitted with a flat spring positioned parallel to the support. The spring is attached at one end to the support. A tooth or dog is attached to the other end of the spring which biases the tooth through the slot support. The forward side of the tooth is perpendicular to the spring and support. The tooth is beveled on the rearward side to permit easy ingress of rockets into the tube during loading. The tooth also has a second bevel or lip at the rear to effect locking engagement of the tooth and the support to positively resist deflection of the tooth in the slot when any reverse (egress) force parallel to the spring or centerline of the launch tube is applied to the tooth.

For operation, this detent assembly is affixed to the rear end of a rocket launch tube, with the tooth positioned at the extreme rear of the tube and protruding toward the longitudinal center line of the tube. The bevel in the tooth permits the tooth to deflect during loading of a rocket into the tube. When the rocket is completely inserted into the tube, the spring forces the tooth to snap in place behind the rocket, restraining it in the tube. When any force is applied to the rocket to force it out the back of the tube in a reverse direction to loading and parallel to the center line of the tube, the rocket is restrained at its rear edge by the forward edge of the tooth. If the force on the rocket is large, then the tooth is rotated slightly in the slot until the restraining bevel of the tooth and the rear surface of the slot make contact. This contact prevents any motion of the tooth out of the slot and thereby secures the rocket in the tube—even for extreme loads such as backblast from an adjacent rocket. If release of the rocket is desired, the tooth may be easily deflected manually out of the slot by application of force to the tooth in a direction perpendicular to the launch tube center line.

The above and still further objects, novel features and advantages of the present invention will become apparent upon consideration of the following detailed description of one specific embodiment therof, especially when considered in conjunction with the accompanying drawings.

BRIEF DESCRIPTION OF THE DRAWINGS

FIG. 1 is a plan view of the detent in a relaxed position free of external forces;

FIG. 2 is an elevation of the detent in a relaxed position;

FIG. 3 is a plan view of the detent with tooth in a deflected position during insertion of an object into the storage chamber or as the result of application of manual releasing force.

FIG. 4 is a plan view of the detent with tooth in a locked position after application of a substantial force to the tooth in a direction reverse to that present during insertion;

FIG. 5 is a plan view of a typical rocket;

FIG. 6 shows isometric views of a rocket launch tube assembly mounted on a tracked carrier;

FIG. 7 is a rear view of the rocket launch tube assembly; and

FIG. 7*a* shows a trio of detents installed at the rear of a rocket launch tube.

DESCRIPTION OF THE PREFERRED EMBODIMENT

Referring to the drawings in detail, there is illustrated a detent which includes a support 1 with slot 2, a tooth 3, a flat spring 4, a pull 5, spring retention screws 6, spacer 8, spring alignment pin 9, spring washer 10, tooth/pull retaining screws 11, and tooth pin 12. The support includes mounting grooves 13 and 14 for interface with support bands which may be installed in the launch tube. A hole 15 is provided for securing the support 1 to a bulkhead on the launch tube assembly. A groove 16 is also provided to position a strap-type clamp used to secure the supports to the launch tube in a circumferential fashion. One end of the support 1 is shaped to form a guide 17. The tooth 3 is provided with a bevel 18 to permit easy loading of an object, and a second bevel or lip 19 for effecting locking upon engagement of bevel 20 in slot 2.

The tooth 3 travels in and out in the slot 2, depending on the influence of external forces, and as influenced by rigid attachment to spring 4 by means of screws 11. The spring is also rigidly attached to the support 1 by means of screws 6. Pins 9 and 12 maintain proper relative position of the tooth 3 and support 1 to permit suitable operation of the tooth 3 in the slot 2.

The position of rest, wherein no external forces are acting on the tooth 3, is shown in FIG. 1. For insertion of an object into the storage chamber from the right, the object makes contact with the protruding bevel on the tooth 3 and the tooth is deflected upward out of the slot as shown in FIG. 3. For locking, the tooth is rotated counterclockwise by means of external reverse forces such as backforce of a fired rocket from an adjacent chamber until the tooth 3 engages the slot 2 as shown in FIG. 4. The characteristic flexibility of the spring 4 permits either a free or locking function of the tooth 3 in the slot 2 as described in more detail below.

The tooth 3 may also be manually lifted up into the slot 2 by application of vertical force to pull 5 as illustrated in FIG. 3.

A rocket 22 with cylindrical tail fin 21 is illustrated in FIG. 5. The rocket 22 is stored and shot from launch tubes 23 as shown in FIGS. 5 and 6. The launch tubes 23 are mounted in a tracked carrier vehicle 24. Backblast 25 is present near the launch tubes 23 after a rocket is shot. Detent assembly 26 is installed on the rear of launch tube 23 as depicted in FIGS. 7 and 7*a*.

OPERATION OF AN EMBODIMENT OF THIS INVENTION

For operation, the detent assembly 26 is typically attached to the rear end of a rocket launch tube 23 by means of a mounting screw passing through hole 15 as depicted in FIGS. 1 and 7*a*. This positions the tooth 3 just beyond the rear edge of the tube 23, and permits the tooth 3 to project inward toward the center line of the tube. The detent assemblies 26 are typically installed in an equally spaced pattern on the outer surface of the launch tube 23. The launch tube 23 is ready for insertion of the rocket 22 with the tooth 3 positioned at rest as shown in FIG. 1. Typically, the extreme outer diameter of the rocket 22 is only slightly less than the inner diameter of the launch tube 23.

When a cylindrical rocket 22 is to be loaded into the tube 23, the rocket is positioned along the center line of the tube, and then inserted into the tube at the rear side (right side of FIGS. 1–4). Just as the rocket 22 nears the rear side of the tube 23, the leading edge of the rocket 22 makes contact with this bevel 18 on the detent. Continual motion of the rocket 22 into the tube 23 causes the tooth 3 to deflect out of the slot 2 to clear a passage for the rocket. When the rocket 22 is completely inserted into the tube 23, action of the spring 4 snaps the tooth 3 back into the slot 2 until it protrudes into the tube through slot 2 in its original position. The tooth 3 now blocks the path of the rocket 23 from leaving the tube in the direction of the guide 17 by means of contact with the rear side of the rocket fin 21.

When an external force, (such as backblast from firing of an adjacent rocket) is applied to the forward edge of rocket 22 in the tube 23, in an egress (rearward) direction toward the guide 17, the rear fin 21 area of the rocket contacts the forward unchamfered side of tooth 3. A sufficiently large force applied by means of the rocket fin 21 to the tooth 3 causes the tooth 3 to rotate in the slot 2 in a counterclockwise direction. This rotational motion of the tooth 3 is initially accompanied by slight motion of the tooth out of the slot 3. The rotational motion of the tooth 3 about itself is also accompanied by deflection of the spring 4 toward the support 1 as shown in FIG. 4. Continued application of the reverse force to the tooth 3 results in contact of the locking bevel 19 of the tooth contacting the locking bevel 20 of the support 1. When these bevels contact, motion of the tooth 3 into the slot 2 ceases. Application of a greater force causes some additional rotation of the tooth 3, the resulting movement on the tooth 3 being resisted by the buckling strength of the spring 4. The spring 4 continues to be deflected toward the support 1 in this condition, as shown in FIG. 4. The rocket is thus securely locked in place in the tube by means of the locking action of the tooth 3 in the slot 2. Typically, the clearance between the beveled side of the tooth 3 and support 1 is 0.020 to 0.030 inch for proper operation.

The deflection of the spring 4 toward the support 1 upon application of a reverse force to the tooth 3 as described above, is proportional to that applied reverse force. Additional applied force from fin 21 causes additional rotation of tooth 3 and additional deflection of spring 4. This phenomenon permits some equalization of the restraining force between more than one detent assembly 26 mounted about tube 23. Economical manufacturing tolerances make it impractical to assemble the detent assemblies 26 on the launch tube 23 within a configuration permitting each tooth 3 of separate detent assemblies 26 to accept reverse load at identically the same time. Contact will be initially made between the fin 21 and only the closest tooth 3 to the fin. If additional reverse force is applied, the first contacted tooth 3 rotates slightly, the first spring 4 deflects slightly until contact is achieved between the fin 21 and a second tooth 3 of a second detent assembly 26. Contact of the fin 21 and all detent teeth 3 is quickly achieved in this fashion to apportion the restraining load on the fin among all the detent assemblies 26 on the launch tube 23 involved.

If a particularly extreme reverse load is applied to a detent assembly 26, the spring 4 will deflect until contact occurs between the spring 4 and support 1. Further buckling deflection of the spring 4 is then restricted, insuring the positive nature of the lock between tooth 3 and support 1. The position and thickness of the spacer 8 controls the buckling restriction characteristic of the spring 4 and support 1. Typically, a spacing between spring 4 and support 1 of approximately one-sixteenth inch is effective.

The rocket may be easily removed from the tube by withdrawing the tooth 3 into the slot 2 by means of a manual lifting force applied to the pull 5 during any period when other external forces are not applied to the rocket 22. The pull 5 is shaped and positioned so that application of the manual force does not rotate the tooth 3 in a counterclockwise direction sufficiently to cause locking of the tooth 3 in the slot 2 as described above. When pull 5 is lifted, spring 4 will not bend inward as in FIG. 4, thus allowing tooth 3 to pass through slot 2. Typically, the manual spring tension to be overcome by lifting on the pull 5 is between 5 and 8 pounds. Once the tooth 3 is withdrawn out of the slot 2, the rocket has a clear path to be removed from the tube.

As is now readily apparent, we have provided a detent that has the advantage of simple construction, easy manual operation and safe, secure locking to resist motion and forces in one direction.

The foregoing relates to a preferred exemplary embodiment of the invention, it being understood that other embodiments and variants thereof are possible within the spirit and scope of the invention, the latter being defined by the appended claims.

We claim:

1. A detent assembly including a slotted support defining at least one slot therein by an inside wall, said slotted support mounted on a hollow support, the detent assembly to detain a movable item in the hollow support, the detent assembly having a spring connected to the slotted support, a restraining tooth connected to the spring such that the spring biases the restraining tooth through the slot in the slotted support and wherein the restraining tooth is rotated against the bias of the spring by movement thereagainst of the item, such that:

as the restraining tooth is rotated against the bias of the spring, the restraining tooth is forced against the inside wall of said slot in the slotted support preventing movement of the item within the hollow support in a first direction.

2. A detent assembly as defined in claim 1, wherein the spring is a flat spring and is mounted on the slotted support such that as the restraining tooth is forced against the slotted support the flat spring is bowed toward the hollow support.

3. A detent assembly as defined in claim 2, wherein the hollow support is a rocket tube and wherein the item is a rocket.

4. A detent assembly as defined in claim 1, wherein the restraining tooth has a bevel which allows movement of the item within the hollow support in a second direction.

5. A detent assembly as defined in claim 4, wherein the inside wall of the slotted support is beveled at the slot and wherein the restraining tooth has a lip such that the lip engages the beveled inside wall when the restraining tooth is forced against the slotted support.

6. A detent assembly as defined in claim 5, wherein the spring is a flat spring and is mounted on the slotted support such that as the lip engages the beveled inside wall the flat spring is bowed toward the hollow support.

7. A detent assembly as defined in claim 5, further having a manually operated pull means, which on actuation removes the restraining tooth from the path of the item to allow movement of the item in the first direction.

8. A detent assembly as defined in claim 7, wherein the spring is a flat spring and is mounted on the slotted support such that as the lip engages the beveled inside wall the flat spring is bowed toward the hollow support.

9. A detent assembly as defined in claim 8, wherein the hollow support is a rocket tube and wherein the item is a rocket.

* * * * *